US005320259A

United States Patent [19]

Weinstein

[11] Patent Number: 5,320,259

[45] Date of Patent: Jun. 14, 1994

[54] VERTICAL RATCHET DISPENSER WITH HINGED TRIGGER

[75] Inventor: Jack Weinstein, Manchester Township, Ocean County, N.J.

[73] Assignee: Primary Delivery Systems, Inc., Easton, Pa.

[21] Appl. No.: 56,866

[22] Filed: May 5, 1993

Related U.S. Application Data

[63] Continuation-in-part of Ser. No. 973,712, Nov. 9, 1992.

[51] Int. Cl.[5] ..... B67D 5/42

[52] U.S. Cl. ..... 222/391; 401/181

[58] Field of Search ..... 401/66, 179, 181; 604/209, 210, 224; 132/318; 206/385; 222/326, 327, 391

[56] References Cited

U.S. PATENT DOCUMENTS

| | | | |
|---|---|---|---|
| 1,467,282 | 9/1923 | Bergen | 401/66 |
| 2,086,462 | 7/1937 | Bost | 604/224 |
| 2,528,839 | 11/1950 | Mason | 401/66 |
| 2,718,299 | 9/1955 | Atwater et al. | 401/66 X |
| 2,872,034 | 2/1959 | Harris | 132/318 |
| 3,221,409 | 12/1965 | Thiel et al. | 222/391 |
| 3,492,993 | 2/1970 | Tillmann | 604/224 X |
| 3,902,814 | 9/1975 | Cardia | 401/66 X |
| 3,977,574 | 8/1976 | Thomas | 222/391 |
| 4,318,499 | 3/1982 | Hamilton | 222/327 |
| 4,323,176 | 4/1982 | Sartain | 222/326 |
| 4,352,579 | 10/1982 | Yi | 401/66 X |
| 4,710,178 | 12/1987 | Leonard et al. | 401/181 X |
| 4,779,770 | 10/1988 | Herold | 222/391 |
| 5,004,124 | 4/1991 | Stefaniak et al. | 222/391 X |

*Primary Examiner*—Andres Kashnikow
*Assistant Examiner*—Kenneth Bomberg
*Attorney, Agent, or Firm*—Kenneth P. Glynn

[57] ABSTRACT

The present invention involves a dispenser. The dispenser includes a main hollow housing with side walls, a base and a top which is at least partially open for dispensing material therethrough. A vertical support column is included within the hollow housing and it has horizontal ratchets thereon as well as a push plate located at its top. A trigger component is also contained within the housing and it is formed of plastic material with at least one flexible portion therein. It acts as a trigger, a ratcheting member and a spring, and is strategically positioned in a hinged manner such that a side wall cut out or other member holding the trigger component against the vertical support column ratchets may be rotated inwardly and released outwardly to cause the ratcheting mechanism to advance the support column. Thus the trigger component has a first position and a second position wherein, when it is moved from the first position to the second position, it advances the vertical support column upwardly and when it is released and moves from its second position back to its first position, it retreats to the next lower ratchet on the support column and is set for the next advance.

8 Claims, 3 Drawing Sheets

VERTICAL RATCHET DISPENSER WITH HINGED TRIGGER

REFERENCE TO RELATED APPLICATION

This application is a continuation-in-part of copending U.S. patent application Ser. No. 07/973,712, filed on Nov. 9, 1992, by the same inventor herein, entitled "Vertical Ratchet Dispenser".

BACKGROUND OF THE INVENTION

1. Field of the Invention

The present invention is directed to dispensers and, more specifically, to vertical ratchet dispensers which are utilized to advance liquids, creams, pastes, cakes, bars and the like to move dispensing material out of the dispenser at rates and times desired by the user. More specifically, the present invention is directed to such dispensers which involve vertical ratcheting by utilization of a unique ratcheting arrangement which functions in combination with a hinged trigger.

2. Prior Art Statement

Numerous ratcheting dispensers have been developed over the years and date back more then half a century. They have been developed for many purposes and have diverse mechanisms for operation. Additionally, various types of tubes and dispensers have been developed to advance cakes and pastes and bar materials such as underarm deodorant bars, lipstick bars, ski wax bars and the like.

U.S. Pat. No. 2,086,462 issued to David E. Bost describes a dispenser for discharging wax or other dispensing material by use of a vertical ratchet mechanism which has a squeeze trigger type handle member and various springs and mechanisms interconnected, including a clamping member and at least three pins or shafts and about six or seven separate pieces for the ratchet advancing mechanism.

U.S. Pat. No. 2,872,034 describes a lipstick container which has a typical twist to advance mechanism.

U.S. Pat. No. 3,221,409 issued to Charles J. Thiel and Louis J. Michaels describes an amalgam dispenser which, again, utilizes a trigger type mechanism with spring, pins and a complex arrangement of components.

U.S. Pat. No. 3,977,574 describes a dispensing pipette actuator system. This system also utilizes a ratcheting mechanism in a vertical direction but requires at least two springs and six or seven components for the ratchet driving mechanism.

U.S. Pat. No. 4,318,499 issued to Joel A. Hamilton, describes a propulsion apparatus with a self contained handle for use with a removable cartridge. This involved movement of hinged, semi-flexible ratcheting members as well as a plurality of springs and pins.

U.S. Pat. No. 4,323,176 describes a manually operable ratchet type dispenser for comestibles which includes a vertical ratcheting mechanism with a handle. This requires at least three pins and four or five complex components.

Thus, notwithstanding the formidable prior art, there seems to be no teaching of the present invention which utilizes a single, semi-flexible component to perform the three functions of a trigger, of a ratcheting member to advance a ratchet column and of a return spring. Thus, separate from the advancing ratchet column itself, the present invention requires only two moving parts, no metal springs and no or minimal set pins.

SUMMARY OF THE INVENTION

The present invention involves a dispenser. The dispenser includes a main hollow housing with side walls, a base and a top which is at least partially open for dispensing material therethrough. A vertical support column is included within the hollow housing and it has horizontal ratchets thereon as well as a push plate located at its top. A trigger component is also contained within the housing and it is formed of plastic material with at least one flexible portion therein. It acts as a trigger, a ratcheting member and a spring, and is strategically positioned in a hinged manner such that a side wall cut-out or other member holding the trigger component against the vertical support column ratchets may be rotated inwardly and released outwardly to cause the ratcheting mechanism to advance the support column. Thus, the trigger component has a first position and a second position wherein, when it is moved from the first position to the second position, it advances the vertical support column upwardly and when it is released and moves from its second position back to its first position, it retreats to the next lower ratchet on the support column and is set for the next advance.

BRIEF DESCRIPTION OF THE DRAWINGS

The present invention will be more fully understood when the disclosure set forth in the specification herein is taken in conjunction with the drawings appended hereto. Those drawings are:

FIG. 7 shows a front cut view of an alternative present invention device which includes a dispensing pouch for liquid, cream or the like.

DETAILED DESCRIPTION OF THE PRESENT INVENTION

The present invention is directed to a ratchet dispenser which is superior to the prior art dispensers due to its particular construction and design as well as its unique function. The improvement of the present invention device involve elimination of metal springs, pins and a significant plurality of components for ratcheting, thus substantially decreasing the likelihood of brakeage, simplifying construction and decreasing costs of manufacture.

Figure 1:
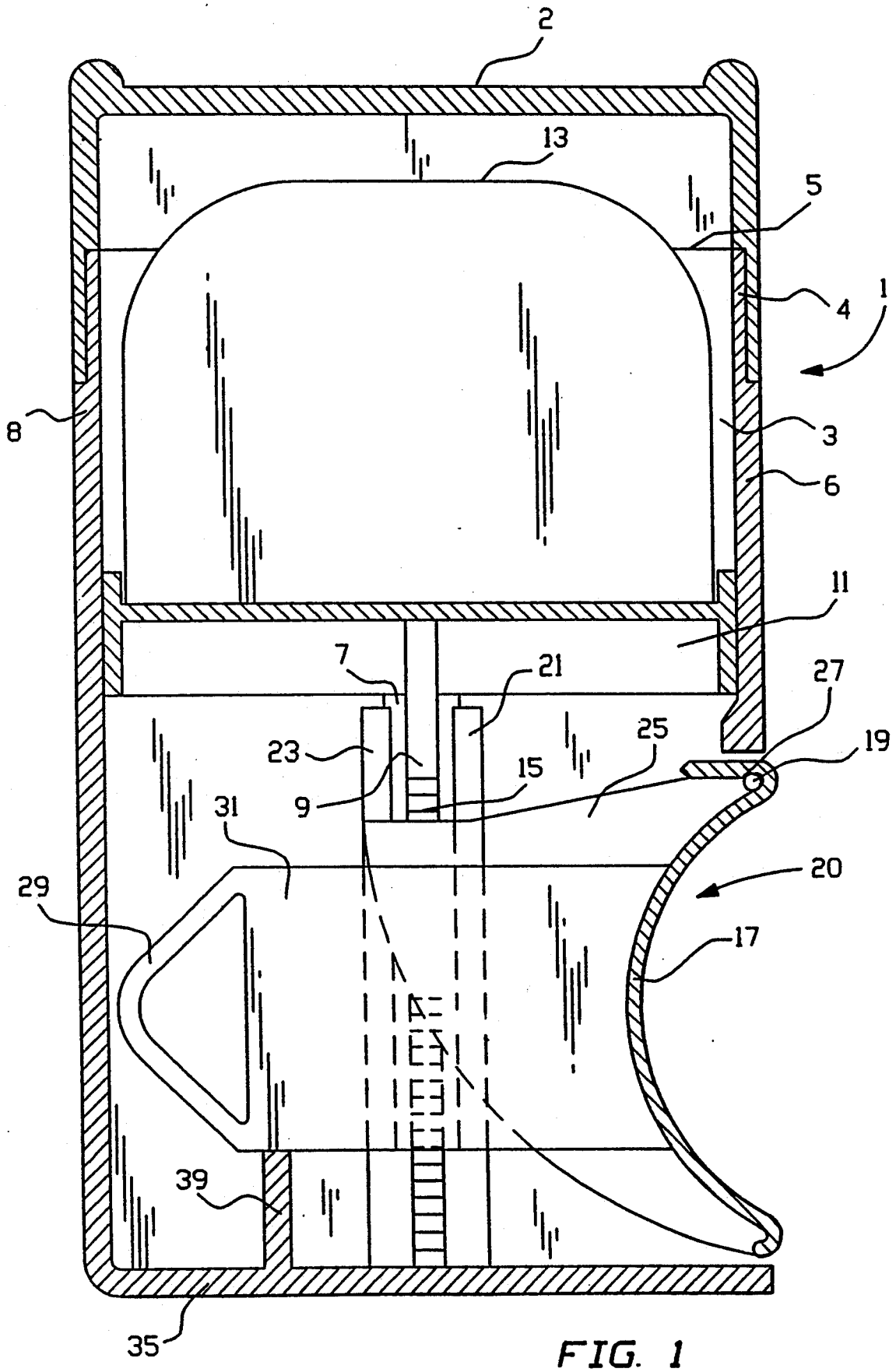
FIG. 1 shows a front cut view of a present invention vertical ratchet dispenser and FIG. 2 shows a rear cut perspective view of the container of the present invention device shown in FIG. 1.

Referring now to FIG. 1 there is shown a front cut view of present invention dispenser 1. Dispenser 1 includes a main hollow housing 3 which has side walls such as side walls 6 and 8 and a base 35. Top 5 is fully open in this embodiment, as it has been developed for dispensing of stick materials such as deodorant stick 13. Extended wall portion 4 is adapted to receive lid 2, as shown.

A vertical support column 7 includes vertical ratchet track 9 with ratchets such as ratchet 15 and is connected to push plate 11. There are guide columns 21 and 23 inside housing 3 in which vertical support column 7 may move upwardly and downwardly, except for its restraint and advance by trigger component 20, discussed below.

Trigger component 20 acts as a trigger, as a ratcheting member and as a spring. It includes trigger lever 17 which is movably connected to main hollow housing 3, i.e. cut out 27 of lever 17 is snapped on or otherwise connected to housing 3 at peg 19 so as to be rotatable or swingable into housing 3. Ratchet advancer fin 25 interacts with ratchet track 9 such that when lever 17 is pushed in, advancer fin 25 swings up and advances and holds track 9 up one ratchet length, thereby advancing push plate 11 and stick 13.

Not only is trigger component 20 functioning as a trigger and a ratcheting advancer, but it also includes spring plate 31 with springy, flexible portion 29. This automatically pushes lever 17 back to its first position (rest position) by springing back from wall 8 so that it and ratchet advancer fin 25 are reset for the next advance. Rest post 39 of base 35 acts as a stop to prevent lever 17 from swinging out beyond its desired rest position.

In preferred embodiments, as shown, the trigger component is unistructurally formed by being molded into one piece but may alternatively be an assemblage of two or more parts. However, there are significant manufacturing advantages achieved when unistrutured molding is employed, including ease of manufacture, lower cost, fewer parts, less assemblage, less reject rate, etc.

Figure 2:
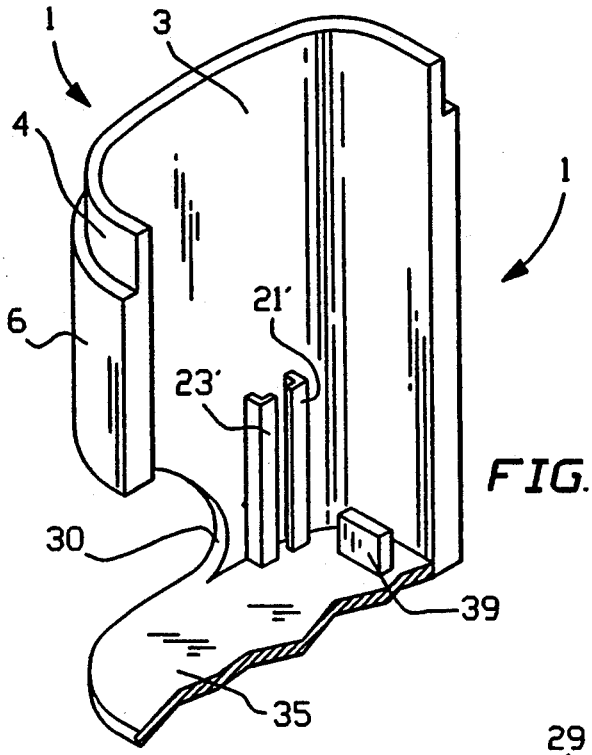

FIG. 2 shows a rear oblique view of a portion of a present invention dispenser 1 housing 3, with identical parts being identically numbered. Here, guide columns 21' and 23' as well as rest 39, are shown in perspective relative to housing 3, and opening 30 is shown for receiving trigger component 20.

Figure 3:
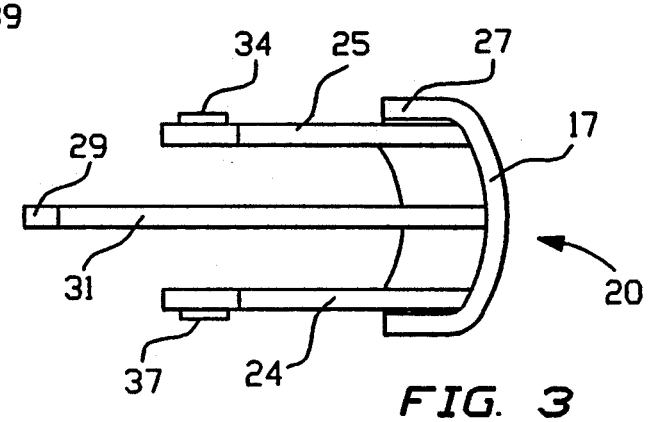
FIG. 3 shows a top view of a present invention device trigger component which utilized in the FIGS. 1 and 2 present invention device.

FIG. 3 shows a top view of trigger component 20. Again, all identical parts are identically numbered. It is clear from FIG. 3 that advancer fin 25 has an opposite counterpart fin 24 and ledges 34 and 37 act to advance a pair of ratchet tracks such as track 9. As an alternative, fins 24 and 25 could extend and include a springfield portion, but in embodiments such as dispenser 1, the curved walls render a center spring portion preferred.

Figure 4:
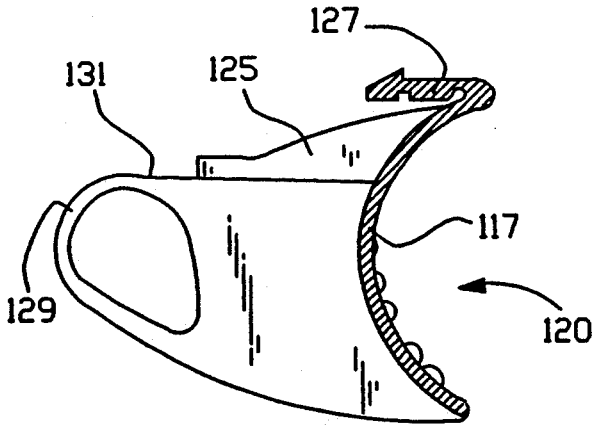
FIGS. 4 and 5 illustrate side view and blown up partial view of an alternative trigger component with ratchet release capability to render a present invention dispenser refillable.
Figure 5:
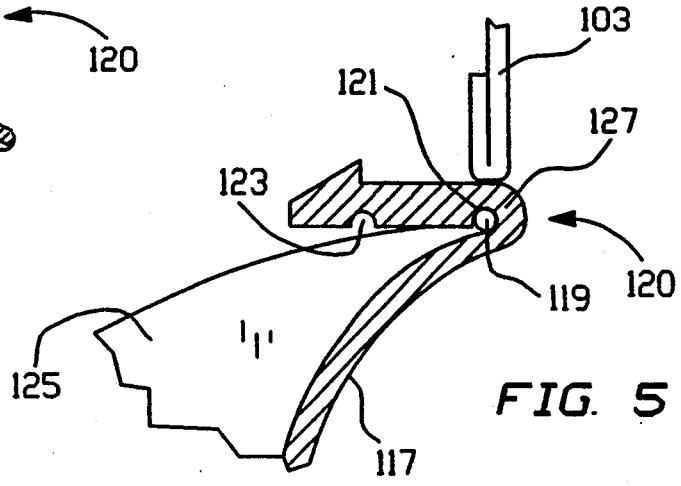

Referring now to FIGS. 4 and 5 together, there is shown a front cut view and a blow-up portional view of an alternative trigger component 120. Included is fin 125, extended portion 131 and spring 129. In this embodiment, lever 117 includes an extension 127 with cut-outs 121 and 123. FIG. 5 shows a portion of a dispenser sidewall 103 and its peg 119 with trigger component 120 connected thereto at cut-out 121 of extension 127. This is the normal, ratcheting-up position. However, in this embodiment, lever 117 may be pulled out so that cut-out 123 slips into peg 119. In this position, ratchet ledges are not in contact with ratchet tracks and thus, a push plate may be pushed down and reset for another full length of ratchet advancement when lever 117 is pressed back into its ratchet-up position, i.e. with cut-out 121 on peg 119. Thus, this may be used in a dispenser such as dispenser 1 of FIG. 1 with refillable capabilities.

Figure 6:
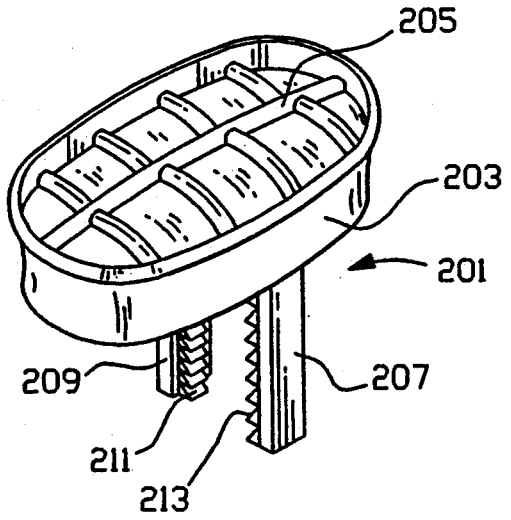
FIG. 6 illustrates a vertical support column in its front perspective view for insertion into a present invention device.

FIG. 6 shows an oblique view of a push plate component 201 useful in a present dispenser. Vertical ratchet columns 207 and 209 symmetric and oppositely located and include ratchets such as ratchet 211 and ratchet 213 respectively. Push plate 203 includes cross-members, such as member 205, to secure a cake or stick of dispensing material.

Figure 7:
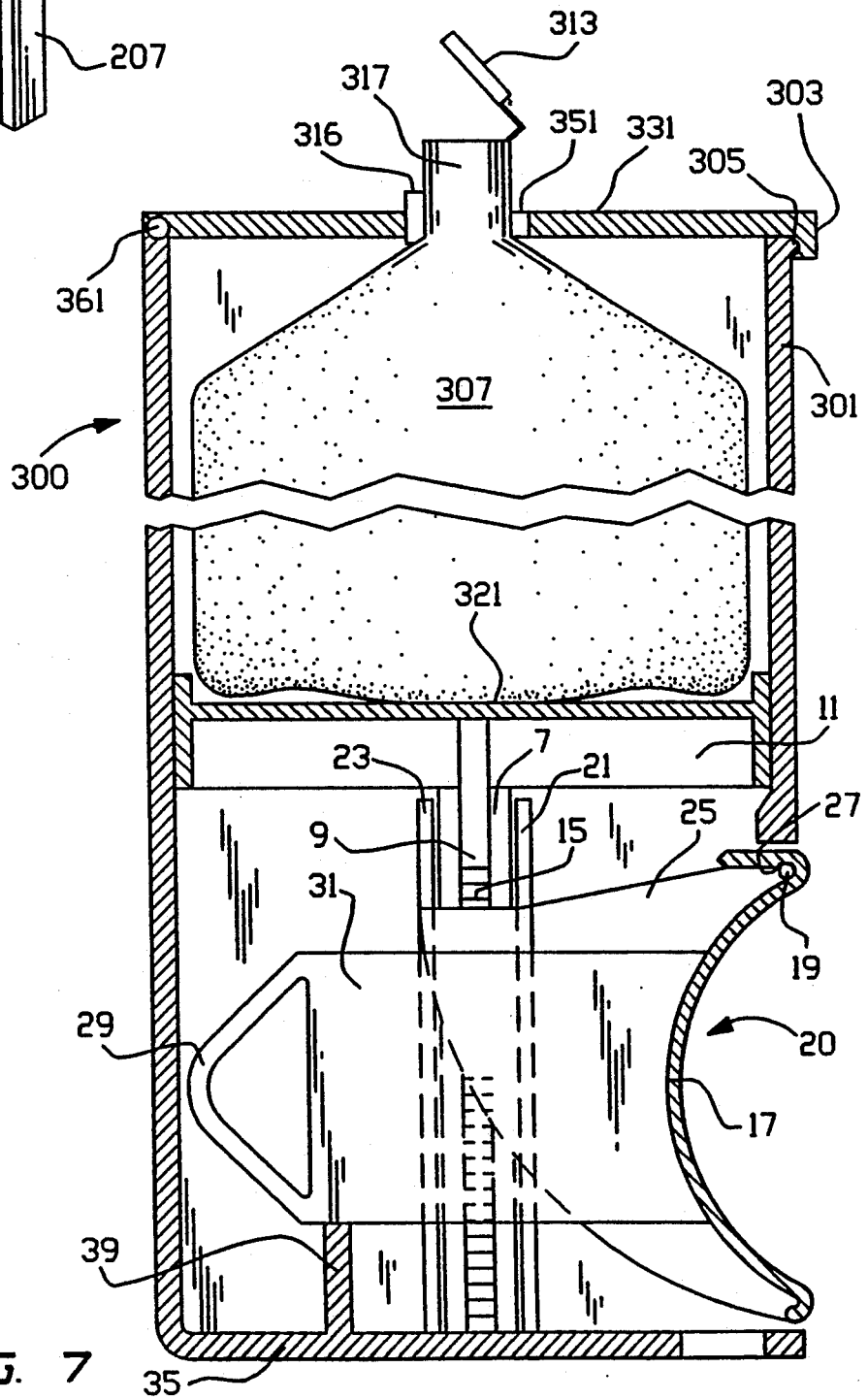

Referring now to FIG. 7 there is shown a front view of an alternative embodiment present invention dispenser 300. In FIG. 7, the trigger component 20 is the same as in FIG. 1 and all identical parts are identically numbered.

In this embodiment, tapered push plate 11 advances against the base 321 of pouch 307 so as to push upwardly and squeeze material out of pouch 307. Cap 313 is shown as a snap cap but may be a screw cap or otherwise. Additionally, top orifice 351 may be notched so as to receive stop 316 and enable pouch 307 to be maintained in a fixed position. The notch may be tapered so as to limit downward movement of neck 351 or, alternatively, neck 317 could have a lip or ledge or any other mechanism might be used as long as there would be some way to rotate and remove or otherwise pull pouch 307 away from top 331 when top 331 is removed. For example, it might be that neck 317 would have to be lifted upwardly and then lowered down through orifice 351 provided that there were adequate clearances. Note that top 331 has a hinge member 361 as well as a latching means 303 which connects to male latch portion 305 to maintain top 331 in a closed position. However, it can be seen that with adequate force, top 331 could be removed and pouch 307 replaced with a new supply of material. Additionally, dispenser 300 could have a larger pouch capability so that more than 60 or 70 percent of the space could contain pouch volume so as to provide a larger supply of dispensing material relative to the size of the dispenser itself.

Obviously, numerous modifications and variations of the present invention are possible in light of the above teachings. It is therefore understood that within the scope of the appended claims, the invention may be practiced otherwise than as specifically described herein.

What is claimed is:

1. A dispenser, comprising:

(a) a main hollow housing having sidewalls, a base and a top which is at least partially open for dispensing material therethrough;

(b) a vertical support column having horizontal ratchets thereon, said support column being vertically slidable mounted within said main hollow housing;

(c) a push plate located at the top of said support column;

(d) a trigger component movably connected to said main hollow housing and to the horizontal ratchets of said vertical support column, said trigger component having a separate flexible spring portion and advance fin both extending generally perpendicular to said trigger component, said trigger member being rotatably and recyclably movable between a first position and a second position such that when said trigger component is moved from said first position to said second position, it moves the vertical support column upwardly one ratchet length, and when said trigger component is moved from said second position to said first position, it retreats to a next lower horizontal ratchet of said vertical support column;

wherein said top of said housing is open sufficiently to dispense a cake material and wherein said push plate includes means for holding a portion of said cake material therein.

2. The dispenser of claim 1, wherein said sidewalls of said housing has a cut out and a peg so as to be connected to a top portion of said trigger component.

3. The dispenser of claim 2, wherein said trigger component flexible spring portion acts as a spring biased against a portion of said sidewalls of said housing.

4. The dispenser of claim 2, wherein said top portion of said trigger component includes a plural position attachment means for attachment thereof to said housing peg, said attachment means having an active position and a passive position wherein, in said active position, said advancing fin of said trigger component is in functional contact with said ratchets of said vertical support column, and, in said passive position, said advancing fin of said trigger component is not in functional contact with said ratchets of said vertical support column.

5. The dispenser of claim 4, wherein said spring portion acts as a spring biased against a portion of said sidewalls.

6. The dispenser of claim 1, wherein said trigger component flexible spring portion acts as a spring biased against a portion of said sidewalls of said housing.

7. The dispenser of claim 1, wherein a top portion of said trigger component includes a plural position attachment means for attachment thereof to said housing, said plural position attachment means having an active position and a passive position wherein, in said active position, said advancing fin of said trigger component is in functional contact with said ratchets of said vertical support column, and, in said passive position, said advancing fin of said trigger component is not in functional contact with said ratchets of said vertical support column.

8. The dispenser of claim 1, wherein said vertical support column is resetable to a lowest position from an upper position for use with subsequent unit of material to be dispensed.

* * * * *